US006494475B2

(12) United States Patent
Rossi et al.

(10) Patent No.: US 6,494,475 B2
(45) Date of Patent: Dec. 17, 2002

(54) WHEELCHAIR FOOT REST OR LEG REST ATTACHMENT BRACKET

(75) Inventors: Greta Y. Rossi, 59 Hillcrest Dr., Hopkinton, MA (US) 01748; Obaida A Abdulky, Worcester, MA (US)

(73) Assignee: Greta Y. Rossi, Hopkinton, MA (US)

( * ) Notice: Subject to any disclaimer, the term of this patent is extended or adjusted under 35 U.S.C. 154(b) by 18 days.

(21) Appl. No.: 09/865,770

(22) Filed: May 25, 2001

(65) Prior Publication Data

US 2002/0020986 A1 Feb. 21, 2002

Related U.S. Application Data

(60) Provisional application No. 60/207,669, filed on May 26, 2000.

(51) Int. Cl.[7] ..... A61G 5/12

(52) U.S. Cl. ..... 280/304.1; 297/423.25; 297/423.4

(58) Field of Search ..... 280/250.1, 304.1, 280/291; D12/131; 297/423.19, 423.25, 423.37, 423.4

(56) References Cited

U.S. PATENT DOCUMENTS

| | | | | |
|---|---|---|---|---|
| 2,868,275 A | | 1/1959 | Mize | |
| 3,230,010 A | | 1/1966 | Mommsen | |
| 3,453,027 A | * | 7/1969 | Pivacek | 297/423.37 |
| 3,857,606 A | | 12/1974 | Rodaway | |
| 4,722,572 A | * | 2/1988 | Sata | 297/423.37 |
| 4,988,114 A | * | 1/1991 | Thornton, Jr. et al. | 280/304.1 |
| 5,033,793 A | | 7/1991 | Quintile | |
| 5,378,041 A | | 1/1995 | Lee | |
| 5,401,045 A | * | 3/1995 | Foerster et al. | 280/304.1 |
| 5,711,580 A | | 1/1998 | Barclay et al. | |
| 6,168,238 B1 | | 1/2001 | Hannagan | |
| 6,182,982 B1 | * | 2/2001 | Fleigle | 280/43 |
| 6,196,565 B1 | * | 3/2001 | Chubbuck | 280/304.1 |

FOREIGN PATENT DOCUMENTS

| | | | | |
|---|---|---|---|---|
| DE | 2754978 | * | 6/1979 | 280/304.1 |

* cited by examiner

*Primary Examiner*—Daniel G. DePumpo
(74) *Attorney, Agent, or Firm*—Mirick, O'Connell, DeMallie & Lougee, LLP

(57) ABSTRACT

A bracket for attaching a wheelchair footrest or leg rest to the front side of a wheelchair frame, wherein the wheelchair frame front side carries a pair of vertically-spaced attachment pins, the invention comprising a support post; a single bracket assembly, coupled to the support post, for mechanically coupling the support post to the wheelchair frame's front side, and defining a first opening for accepting one attachment pin; and an annular member fitted around the support post, and vertically adjustable with respect to the support post, defining a second opening for accepting the other attachment pin, to allow the bracket to be used with wheelchairs having attachment pins with different vertical spacing and different diameters.

13 Claims, 3 Drawing Sheets

WHEELCHAIR FOOT REST OR LEG REST ATTACHMENT BRACKET

CROSS-REFERENCE TO RELATED APPLICATION

This application claims priority of Provisional Applications No. 60/207,669, filed on May 26, 2000, and a second Provisional Application entitled "Adjustable Dual Latch Mechanism for the Adjustable Leg Rest Bracket for Wheelchairs" by Greta Y. Rossi, mailed to the patent office on or about Feb. 19, 2001 (filing receipt not received yet).

FIELD OF THE INVENTION

This invention relates to a bracket for attaching a wheelchair foot rest or leg rest to the front side of a wheelchair frame.

BACKGROUND OF THE INVENTION

Wheelchairs are ubiquitous. There are many different styles and models of wheelchairs, most of which have the ability to have leg rests or foot rests attached to the two front sides of the wheelchair frame. When a patient is admitted to a medical facility, a therapist or other medical professional must find an appropriate wheelchair and leg rests or foot rests that fit the chair. Because there are a dozen or more different brands and styles of wheelchairs in the average facility, each of which has its own style of leg rest and foot rest, this task can be difficult to accomplish, and requires a large inventory and storage space for each different style of foot rest and leg rest for every type of chair in the facility. These problems are compounded by the fact that when the leg rests and foot rests are taken off the chair, they may be misplaced or poorly organized. The result is extra equipment costs and lost personnel time simply to add the correct leg rests or foot rests to a wheelchair.

SUMMARY OF THE INVENTION

This invention features a bracket for attaching a wheelchair footrest or leg rest to the front side of a wheelchair frame, wherein the wheelchair frame's front side carries a pair of vertically-spaced attachment pins, comprising: a support post; means for mechanically coupling the support post to the wheelchair frame's front side; first means, coupled to the support post, defining a first opening for accepting one attachment pin; and second means, coupled to the support post, defining a second opening for accepting the other attachment pin; wherein at least one of the first and second means is vertically adjustable, to allow the bracket to be used with wheelchairs having attachment pins with different vertical spacing. The means for mechanically coupling and the first means may both be part of a single bracket assembly. The means for mechanically coupling may comprise a pivoting member defining an opening to fit around the wheelchair frame's front side. The means for mechanically coupling may further comprise a latch, for holding the pivoting member in a closed position located around the wheelchair frame's front side.

The second means may comprise a fitting movable with respect to the support post. The fitting may be an annular member fitted around the support post. The second means may further comprise a thumb screw for coupling and releasing the annular member from the support post. The support post and the annular member may both have a generally rectangular cross section.

In a more specific embodiment, the invention features a bracket for attaching a wheelchair footrest or leg rest to the front side of a wheelchair frame, wherein the wheelchair frame's front side carries a pair of vertically-spaced attachment pins, comprising: a support post; a single bracket assembly, coupled to the support post, for mechanically coupling the support post to the wheelchair frame's front side, and defining a first opening for accepting one attachment pin; and an annular member fitted around the support post, and vertically adjustable with respect to the support post, defining a second opening for accepting the other attachment pin, to allow the bracket to be used with wheelchairs having attachment pins with different vertical spacing.

The single bracket assembly may comprise a pivoting member defining an opening to fit around the wheelchair frame's front side. The single bracket assembly may further comprise a latch, for holding the pivoting member in a closed position located around the wheelchair frame's front side. The annular member may further comprise a thumb screw for coupling and releasing the annular member from the support post. The support post and the annular member may both have a generally rectangular cross section.

BRIEF DESCRIPTION OF THE DRAWINGS

Other objects, features and advantages will occur to those skilled in the art from the following description of the preferred embodiments and the accompanying drawings in which.

DETAILED DESCRIPTION OF THE PREFERRED EMBODIMENTS

The invention features a bracket for attaching a wheelchair foot rest or leg rest to the front side of a wheelchair frame, of the type in which the wheelchair frame's front side carries a pair of vertically-spaced attachment pins. The bracket comprises a support post, means for mechanically coupling the support post to the front side of the wheelchair frame, first means, coupled to support post, defining a first opening for accepting one attachment pin, and second means, coupled to the support post, defining a second opening for accepting the other attachment pin. At least one of the first and second means is vertically adjustable. This allows the bracket to be used with wheelchairs having attachment pins at different vertical spacings. The result is a bracket that allows virtually any foot rest or leg rest to be attached to virtually any wheelchair. This reduces inventory costs and time spent in assembling a proper wheelchair foot rest or leg rest structure for a particular patient.

Figure 1:
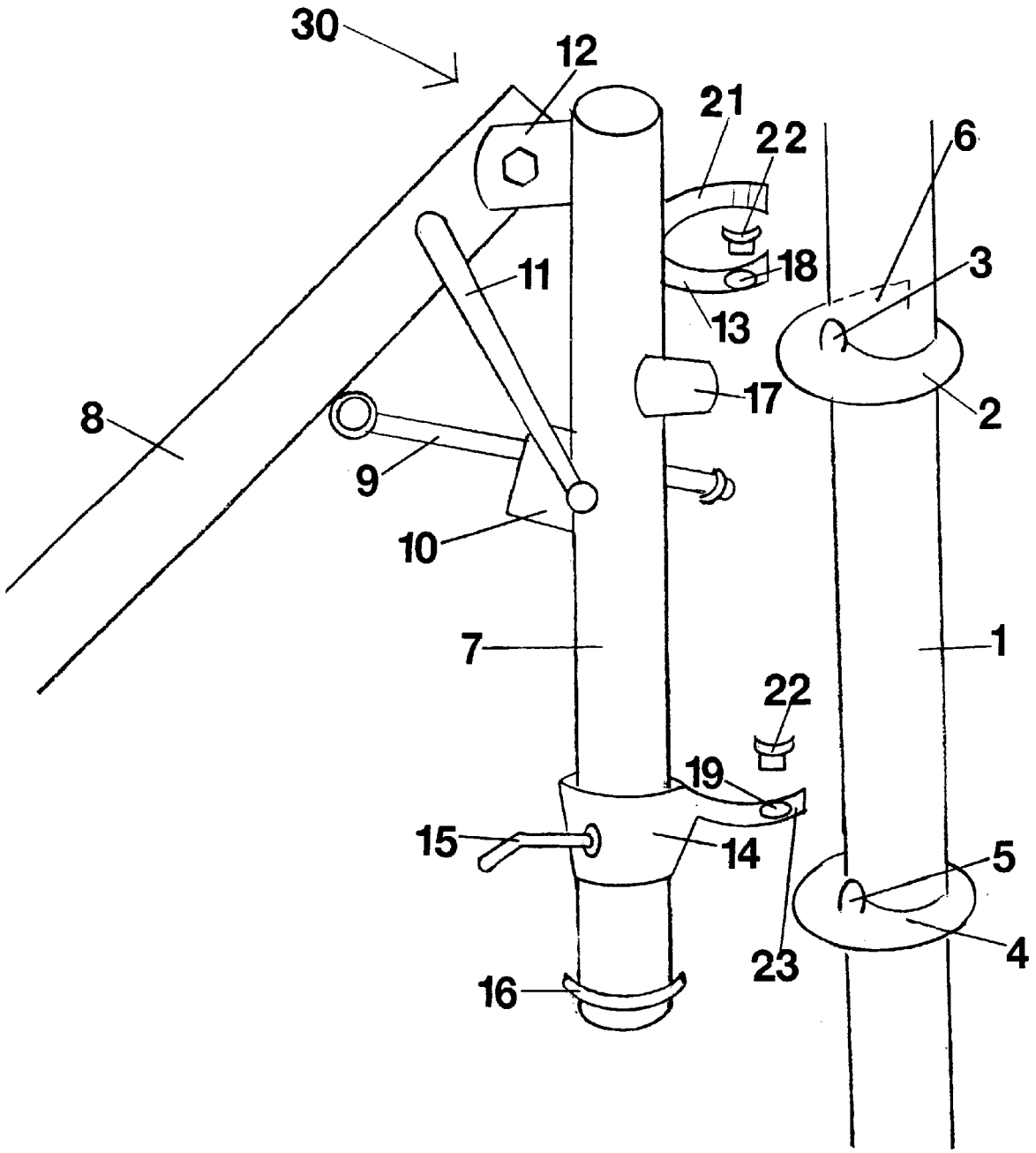
FIG. 1 is a side, partial, disassembled view of one embodiment of the bracket of the invention being attached to the front side of a wheelchair frame.

FIG. 1 shows bracket 30 according to this invention for attaching foot rest or leg rest 8 to front side 1 of a wheelchair frame. Front side 1 carries upper attachment pin 3 and lower attachment pin 5 that are part of portions 2 and 4, respectively, that are welded to tubular wheelchair front side member 1, which has a circular cross-section. Virtually all wheelchair frame front sides are made from one size circular tubing.

Bracket 30 comprises support post 7. Projecting ring 21 with opening 18 is welded to bracket 7. Opening 18 is designed to fit over projecting pin 3. Insert collar 22 can be used to effectively close the size of opening 18 if desired, in order to fit snugly over narrower pins. Rubber bumper or support 17 helps to maintain the proper spacing between side 1 and bracket 7. Elevation rod 9, elevation mechanism 10, and elevation lever 11 allow the elevation of leg rest shaft 8 relative to wheelchair frame side 1, as is know in the art. Although this mechanism is carried by support post 7, it already exists in elevating foot rests, and thus is not a novel part of the invention.

This embodiment of the invention also comprises adjustable support piece 14, which is a collar fitted around post 7 and vertically adjustable (slideable) thereon, with set screw 15 that fixes support piece 14 at a desired vertical location on post 7. Projecting portion 23 defines opening 19 that fits over pin 5. Stop ring 16 prevents support piece 14 from falling off the lower end of support post 7.

This assembly is used as follows. Set screw 15 is loosened and support piece 14 adjusted vertically so that the distance between openings 19 and 18 is correct, so that the openings can be dropped over pins 3 and 5. The inventive bracket thus allows leg rest 8 to be pivotally coupled to wheelchair frame side member 1.

Figure 2A:
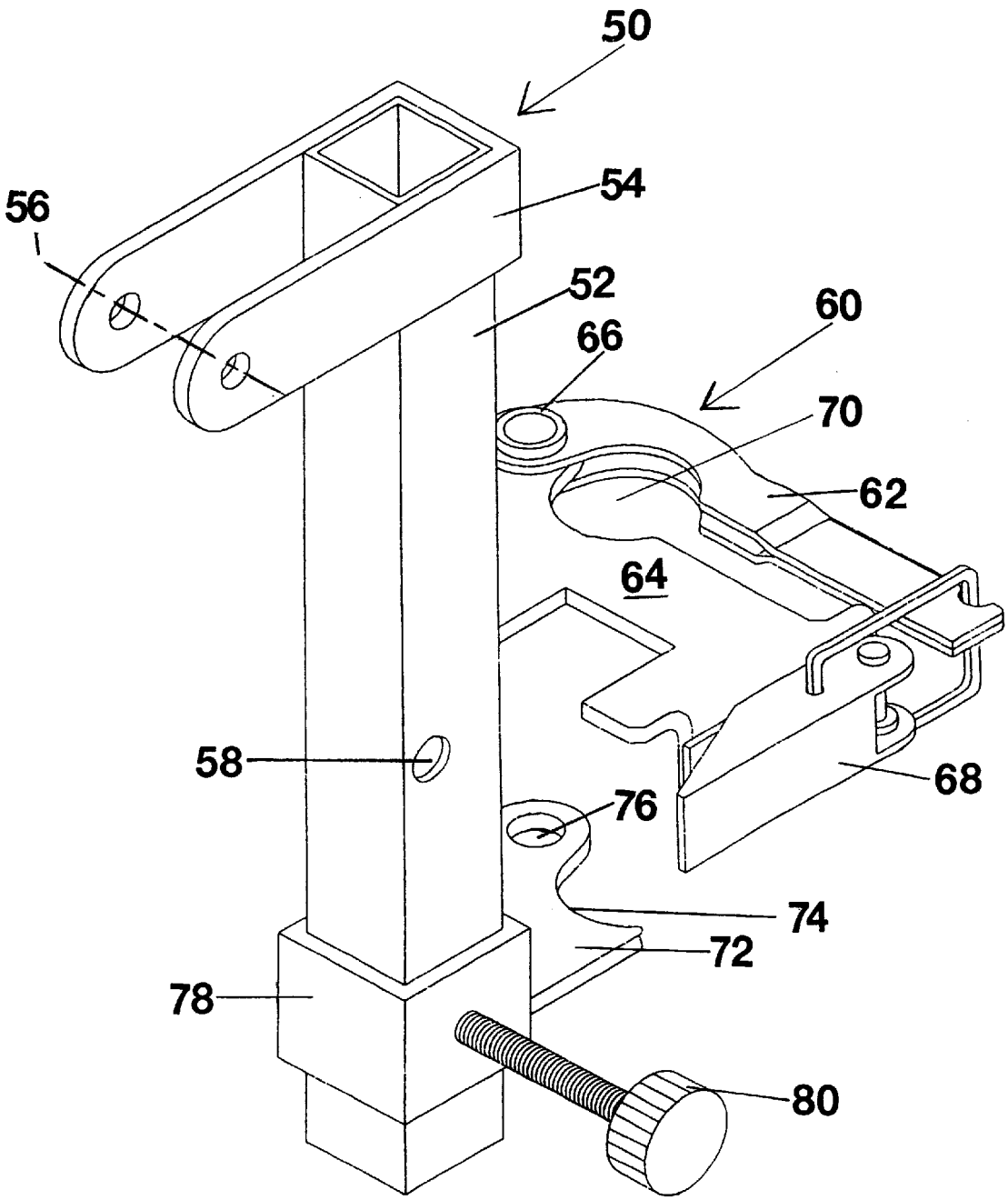
FIG. 2A is an axonometric view of the preferred embodiment of the bracket of the invention.
Figure 2B:
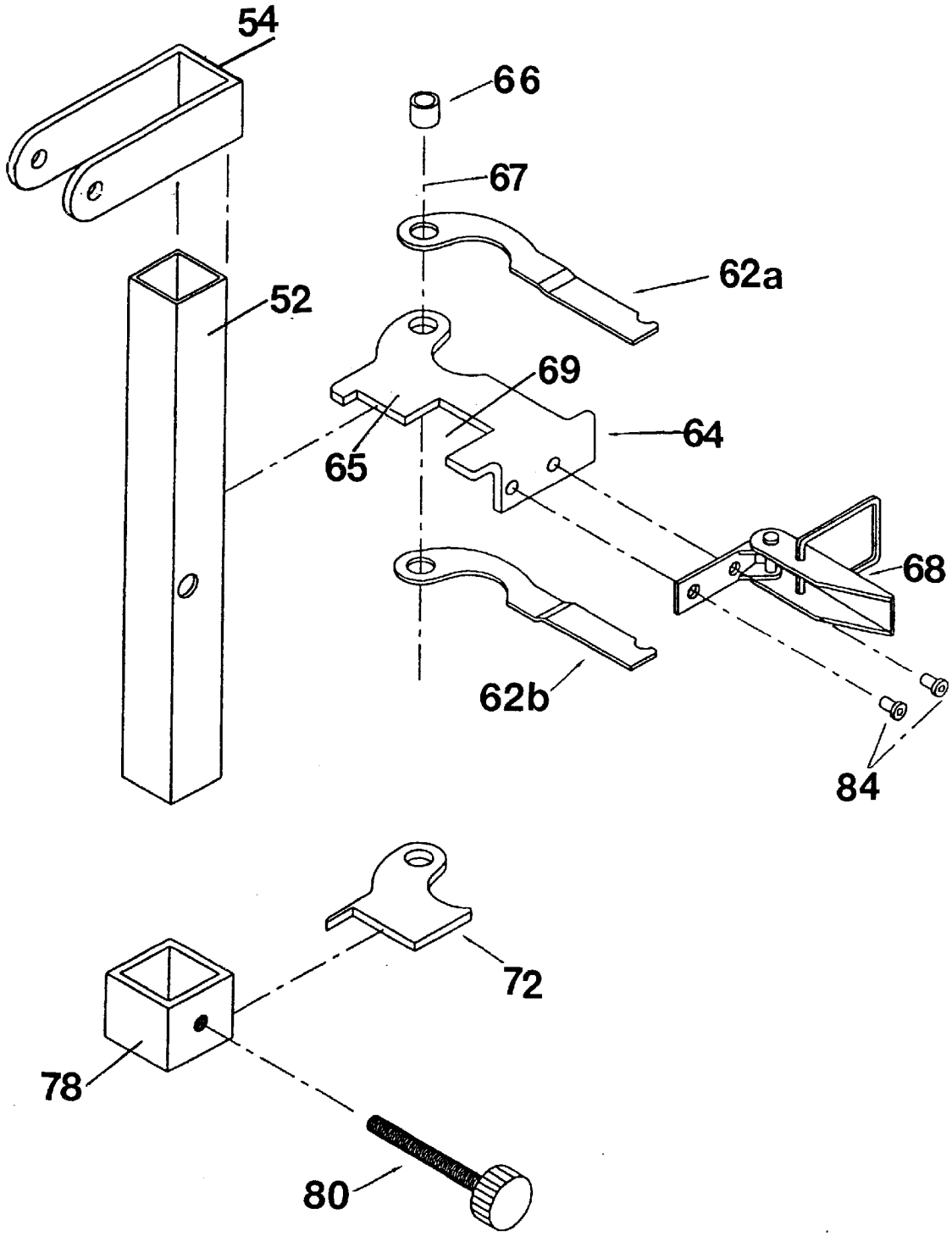
FIG. 2B is an exploded view of the bracket of FIG. 2A.

The preferred embodiment of the inventive bracket of the invention is shown in FIGS. 2A and 2B. Bracket 50 comprises support post 52 that carries hinge member 54 defining axis 56 that accepts the standard upper portion of wheelchair leg rests, such as shown in FIG. 1. Opening 58 is the attachment point for the leg rest elevation mechanism, not shown in FIGS. 2A and 2B.

Bracket 50 comprises means for mechanically coupling the support post 52 to the front side of a wheelchair frame (not shown in this Figure). The bracket also comprises first means, coupled to support post 52, defining a first opening for accepting one attachment pin. In this embodiment, the means for mechanically coupling and this first means are both accomplished in the single bracket assembly 60, which is welded to support post 52 at surface 65, FIG. 2B. Hollow rivet 66, which passes through members 62*a*, 64, and 62*b*, defines the first opening for accepting the upper attachment pin on a wheelchair front side.

Bracket assembly 60 is coupled to a wheelchair frame front side also using pivoting member 62 which, together with member 64, defines generally circular opening 70 that is sized to fit around the standard circular cross section wheelchair frame front side member. Latch 68 allows member 62 to be pivoted relative to member 64 so that the device can fit around the wheelchair frame front side member. Since the inventive bracket is coupled to the wheelchair at three points, points 66, 76, and 70, the bracket is held tight without the need for latch 68 to tightly hold member 62 against the wheelchair frame front side member. Opening 70 may be shaped as more of a kidney shape than a circle, to accommodate for different spatial relationships between the pins and the front frame member on different chairs.

The second means coupled to the support post, defining a second opening for accepting the other attachment pin, is accomplished by bottom bracket 72 defining opening 76. Bracket 72 is welded to rectangular (preferably square) cross section annular member 78 that fits over support post 52 having the same cross-sectional shape. This cross-sectional shape prevents member 78 from rotating relative to post 52. Other shapes could accomplish this same goal, for example a round tube with a flat side. Thumbscrew 80 can be tightened against and released from the surface of support post 52 so that member 78 can be slid up and down along the length of post 52 to adjust the vertical spacing between openings 66 and 76, such as described for FIG. 1. Curved surface 74 of bottom bracket of 72 has the same shape as the wheelchair front side member, so that member 72 rests against the front of the front side member when assembled onto the wheelchair.

Although specific features of the invention are shown in some drawings and not others, this is for convenience only as some feature may be combined with any or all of the other features in accordance with the invention.

Other embodiments will occur to those skilled in the art and are within the following claims:

What is claimed is:

1. A bracket for attaching a wheelchair footrest or leg rest to the front side of a wheelchair frame, wherein the wheelchair frame's front side carries a pair of vertically-spaced attachment pins, comprising:

a support post;

means for mechanically coupling the support post to the wheelchair frame's front side;

first means, coupled to the support post, defining a first opening for accepting one attachment pin; and second means, coupled to the support post, defining a second opening for accepting the other attachment pin;

wherein at least one of the first and second means is vertically adjustable, to allow the bracket to be used with wheelchairs having attachment pins with different vertical spacing.

2. The bracket of claim 1, wherein the means for mechanically coupling and the first means are both in a single bracket assembly.

3. The bracket of claim 1, wherein the means for mechanically coupling comprises a pivoting member defining an opening to fit around the wheelchair frame's front side.

4. The bracket of claim 3, wherein the means for mechanically coupling further comprises a latch, for holding the pivoting member in a closed position located around the wheelchair frame's front side.

5. The bracket of claim 1, wherein the second means comprises a fitting movable with respect to the support post.

6. The bracket of claim 5, wherein the fitting is an annular member fitted around the support post.

7. The bracket of claim 6, wherein the second means further comprises a thumb screw for coupling and releasing the annular member from the support post.

8. The bracket of claim 6, wherein the support post and the annular member both have a generally rectangular cross section.

9. A bracket for attaching a wheelchair footrest or leg rest to the front side of a wheelchair frame, wherein the wheelchair frame's front side carries a pair of vertically-spaced attachment pins, comprising:

a support post;

a single bracket assembly, coupled to the support post, for mechanically coupling the support post to the wheelchair frame's front side, and defining a first opening for accepting one attachment pin; and an annular member fitted around the support post, and vertically adjustable with respect to the support post, defining a second opening for accepting the other attachment pin, to allow the bracket to be used with wheelchairs having attachment pins with different vertical spacing.

10. The bracket of claim 1, wherein the single bracket assembly comprises a pivoting member defining an opening to fit around the wheelchair frame's front side.

11. The bracket of claim 10, wherein the single bracket assembly further comprises a latch, for holding the pivoting member in a closed position located around the wheelchair frame's front side.

12. The bracket of claim 9, wherein the annular member further comprises a thumb screw for coupling and releasing the annular member from the support post.

13. The bracket of claim 12, wherein the support post and the annular member both have a generally rectangular cross section.

* * * * *